US006397603B1

(12) United States Patent
Edmondson et al.

(10) Patent No.: US 6,397,603 B1
(45) Date of Patent: Jun. 4, 2002

(54) CONBUSTOR HAVING A CERAMIC MATRIX COMPOSITE LINER

(75) Inventors: Wayne Garcia Edmondson, Xenia; James Dale Steibel, Hamilton; Harold Ray Hansel, Mason, all of OH (US)

(73) Assignee: The United States of America as represented by the Secretary of the Air Force, Washington, DC (US)

( * ) Notice: Subject to any disclaimer, the term of this patent is extended or adjusted under 35 U.S.C. 154(b) by 0 days.

(21) Appl. No.: 09/567,557

(22) Filed: May 5, 2000

(51) Int. Cl.[7] ..... F23R 3/60

(52) U.S. Cl. ..... 60/753; 60/39.32; 60/746; 60/760

(58) Field of Search ..... 60/39.32, 39.36, 60/746, 747, 748, 752, 753, 756, 757, 760

(56) References Cited

U.S. PATENT DOCUMENTS

| | | | | | |
|---|---|---|---|---|---|
| 2,547,619 | A | * | 4/1951 | Buckland | 60/39.32 |
| 3,385,054 | A | * | 5/1968 | Land | 60/753 |
| 3,982,392 | A | * | 9/1976 | Crow | 60/753 |
| 4,016,718 | A | * | 4/1977 | Lauck | 60/39.32 |
| 4,030,875 | A | * | 6/1977 | Grondahl et al. | 60/753 |
| 4,363,208 | A | * | 12/1982 | Hoffman et al. | 60/753 |
| 4,688,378 | A | * | 8/1987 | Harris | 60/39.32 |
| 5,285,632 | A | | 2/1994 | Halila | 60/39.31 |
| 5,291,732 | A | | 3/1994 | Halila | 60/39.31 |
| 5,291,733 | A | | 3/1994 | Halila | 60/39.31 |
| 5,331,816 | A | | 7/1994 | Able et al. | 60/753 |
| 5,353,587 | A | | 10/1994 | Halila | 60/39.37 |
| 5,363,643 | A | | 11/1994 | Halila | 60/39.31 |
| 5,553,455 | A | | 9/1996 | Craig et al. | 60/753 |
| 5,601,674 | A | | 2/1997 | Szweda et al. | 156/89 |
| 5,851,679 | A | * | 12/1998 | Stowell et al. | 60/753 |

FOREIGN PATENT DOCUMENTS

| | | | | |
|---|---|---|---|---|
| DE | 2713414 | * | 9/1978 | 60/753 |
| JP | 56-102614 | * | 8/1981 | 60/753 |

* cited by examiner

*Primary Examiner*—Ted Kim

(57) ABSTRACT

A combustor having liners made from ceramic matrix composite materials (CMC's) that are capable of withstanding higher temperatures than metallic liners. The ceramic matrix composite liners are used in conjunction with mating components that are manufactured from superalloy materials. To permit the use of a combustor having liners made from CMC materials in conjunction with metallic materials used for the mating forward cowls, and aft seals with attached seal retainer over the broad range of temperatures of a combustor, the combustor is designed to allow for the differential thermal expansion of the differing materials at their interfaces in a manner that does not introduce stresses into the liner as a result of thermal expansion and also balances the flow of cooling air as a result of the thermal expansion.

22 Claims, 15 Drawing Sheets

(COLD)

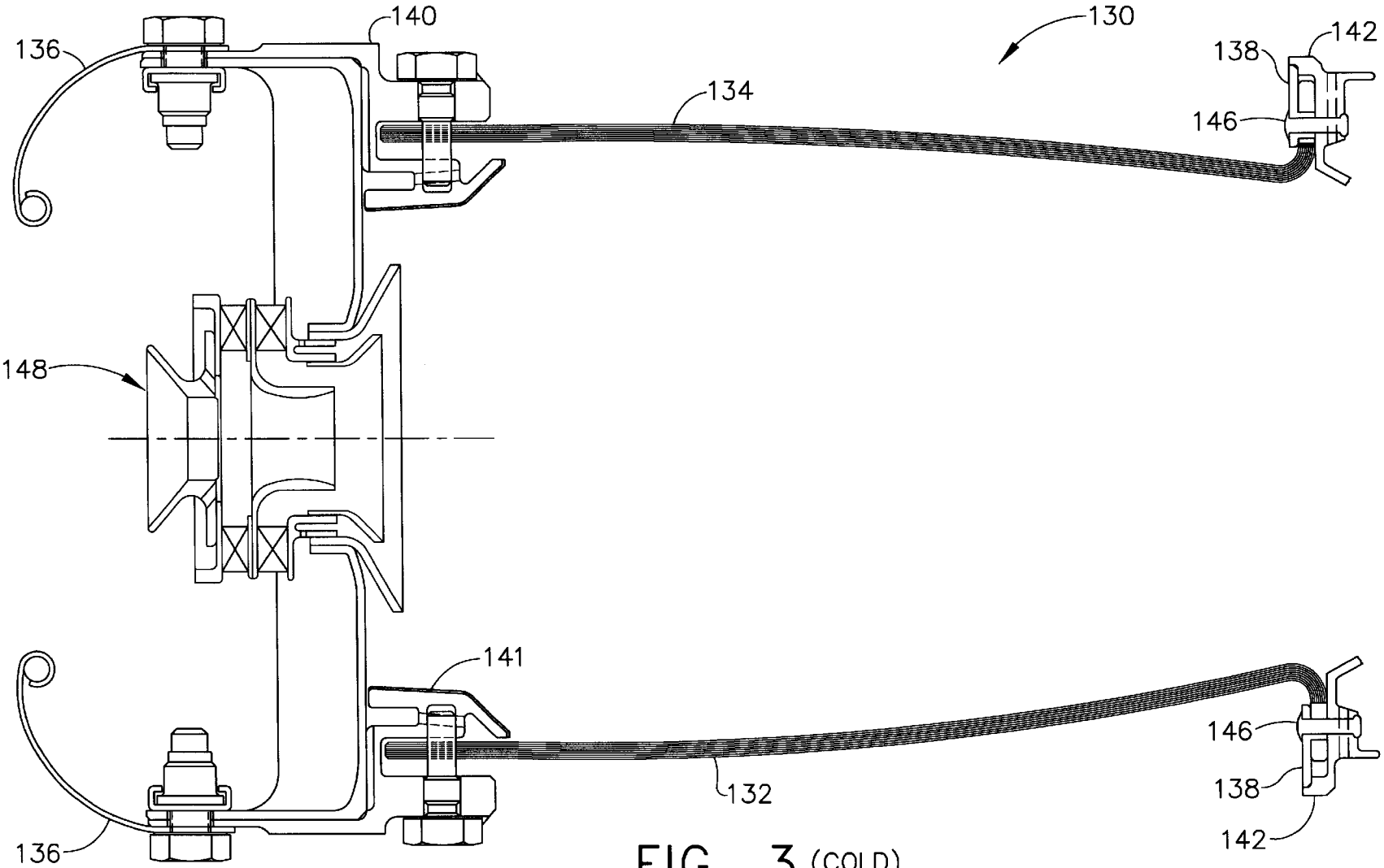
FIG. 3 (COLD)

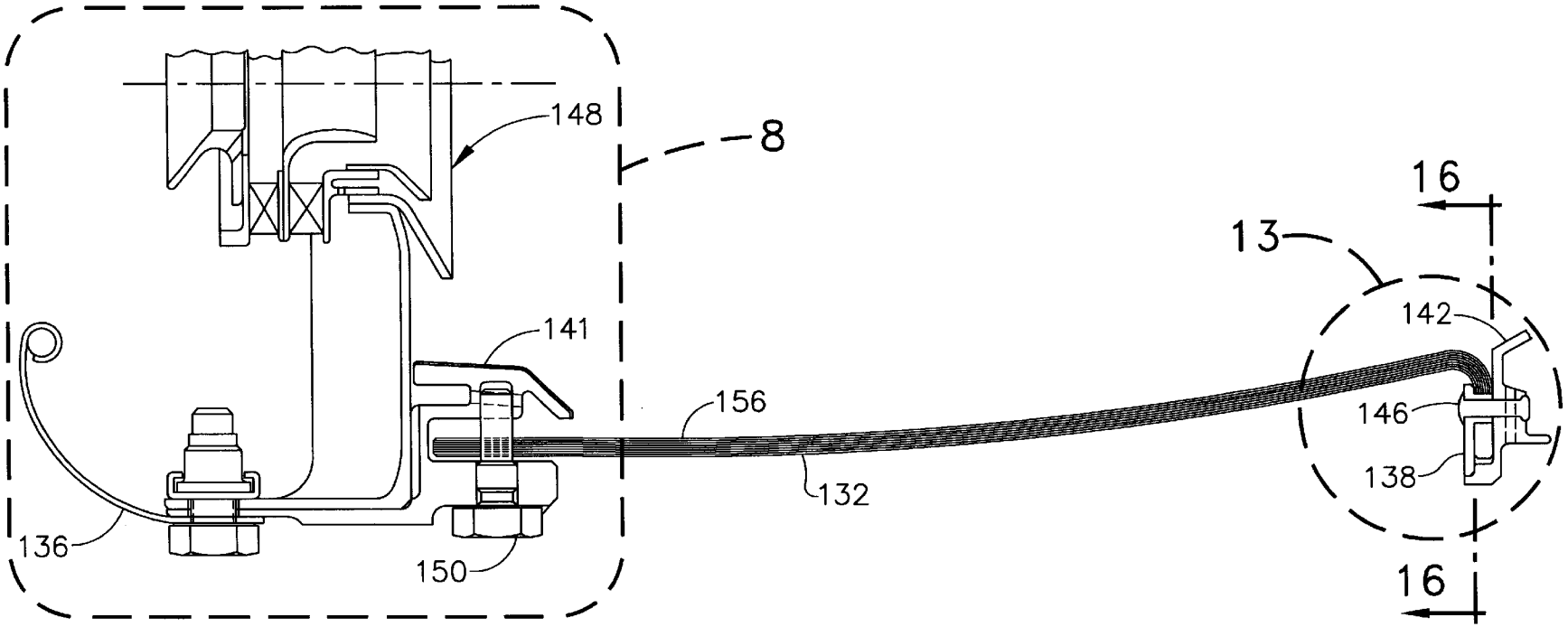
FIG. 4 (HOT)

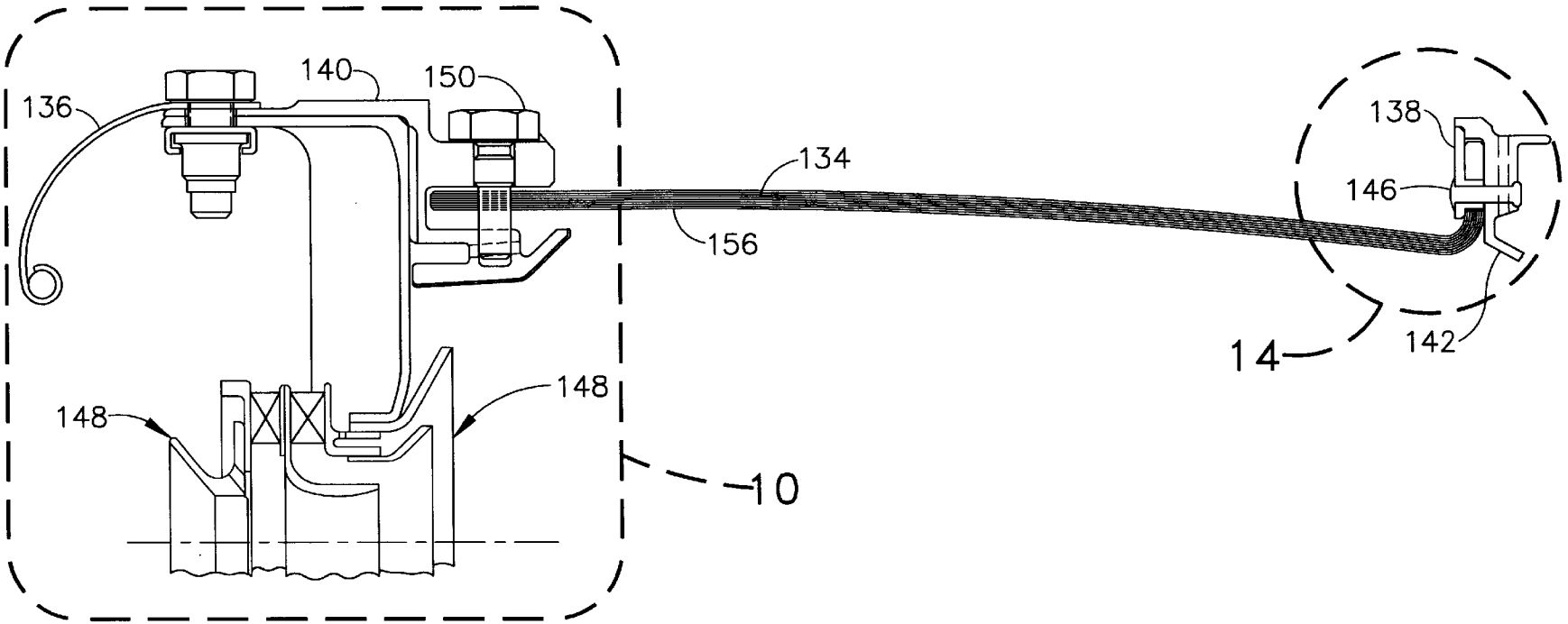
FIG. 5 (COLD)

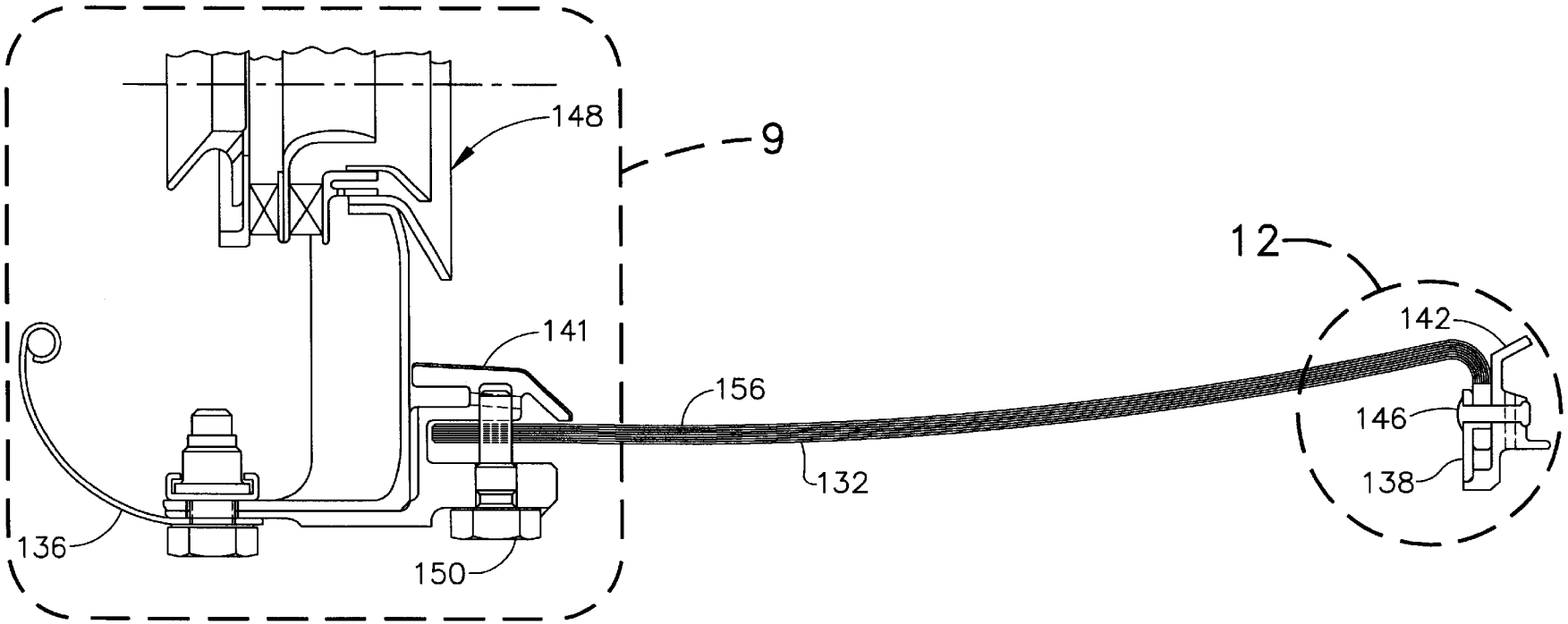
FIG. 6 (COLD)

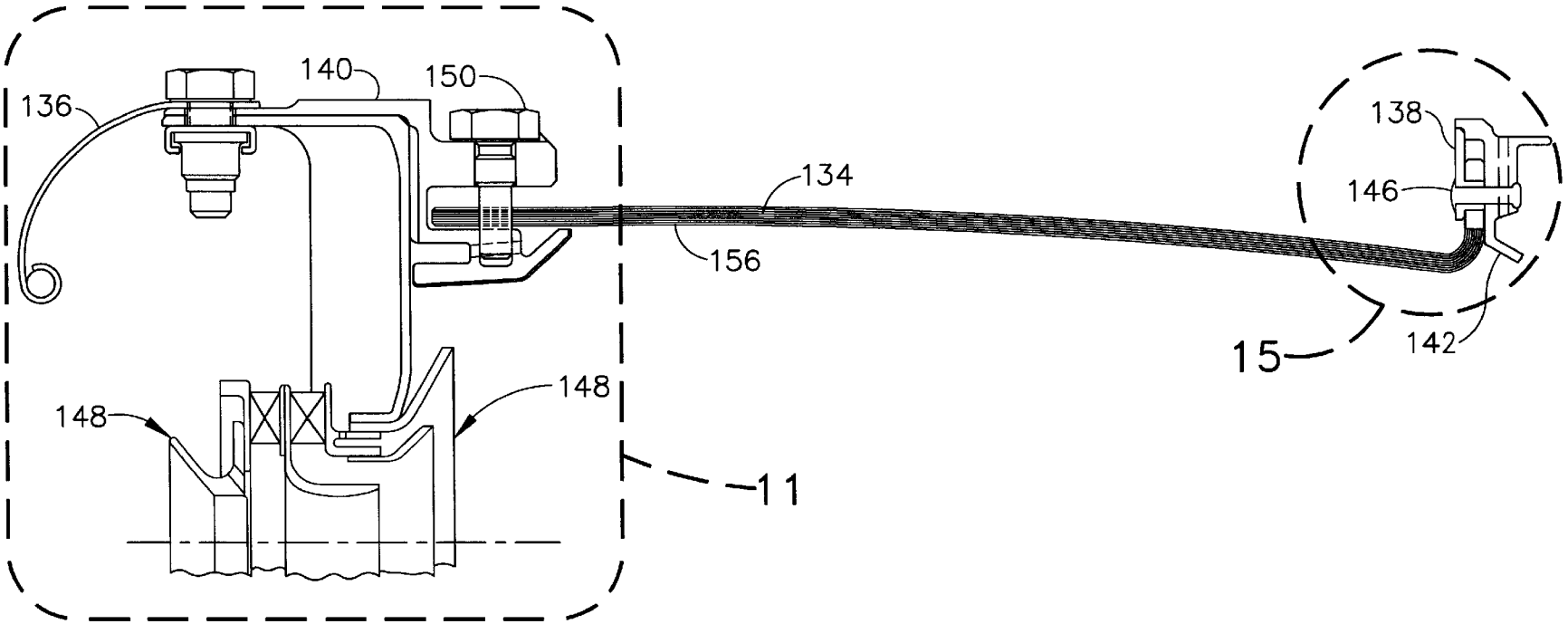
FIG. 7 (HOT)

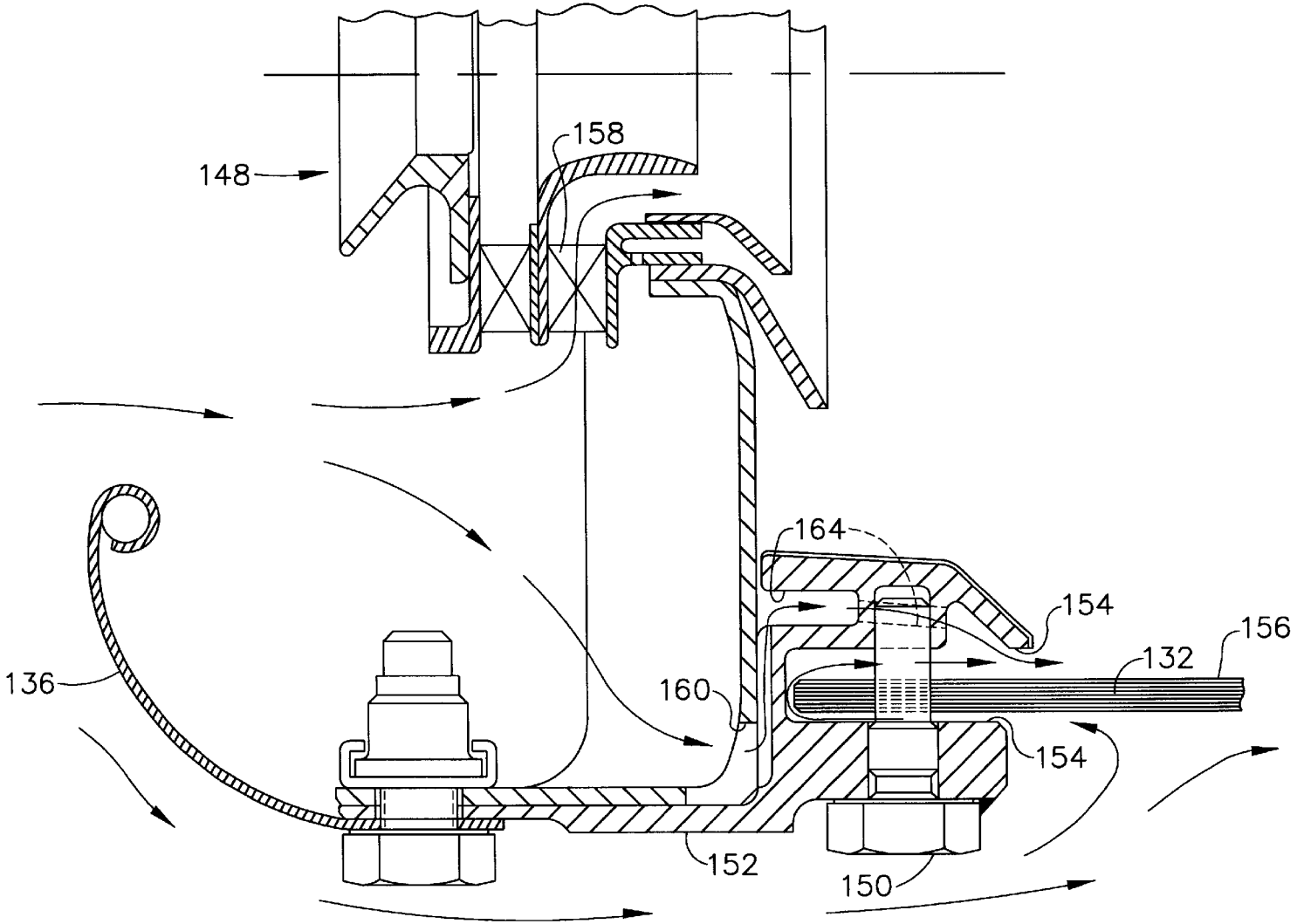
FIG. 8 (HOT)

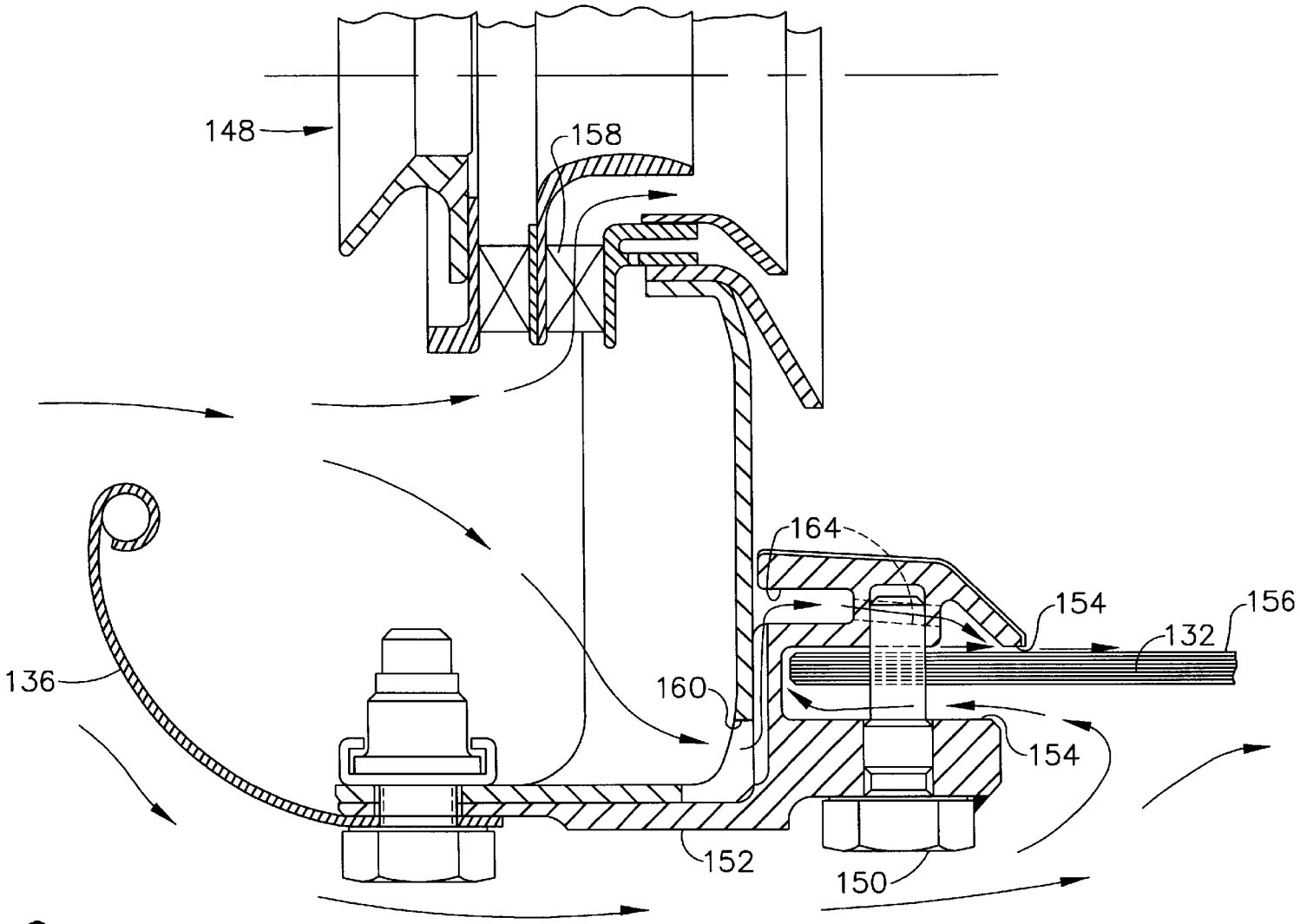
FIG. 9 (COLD)

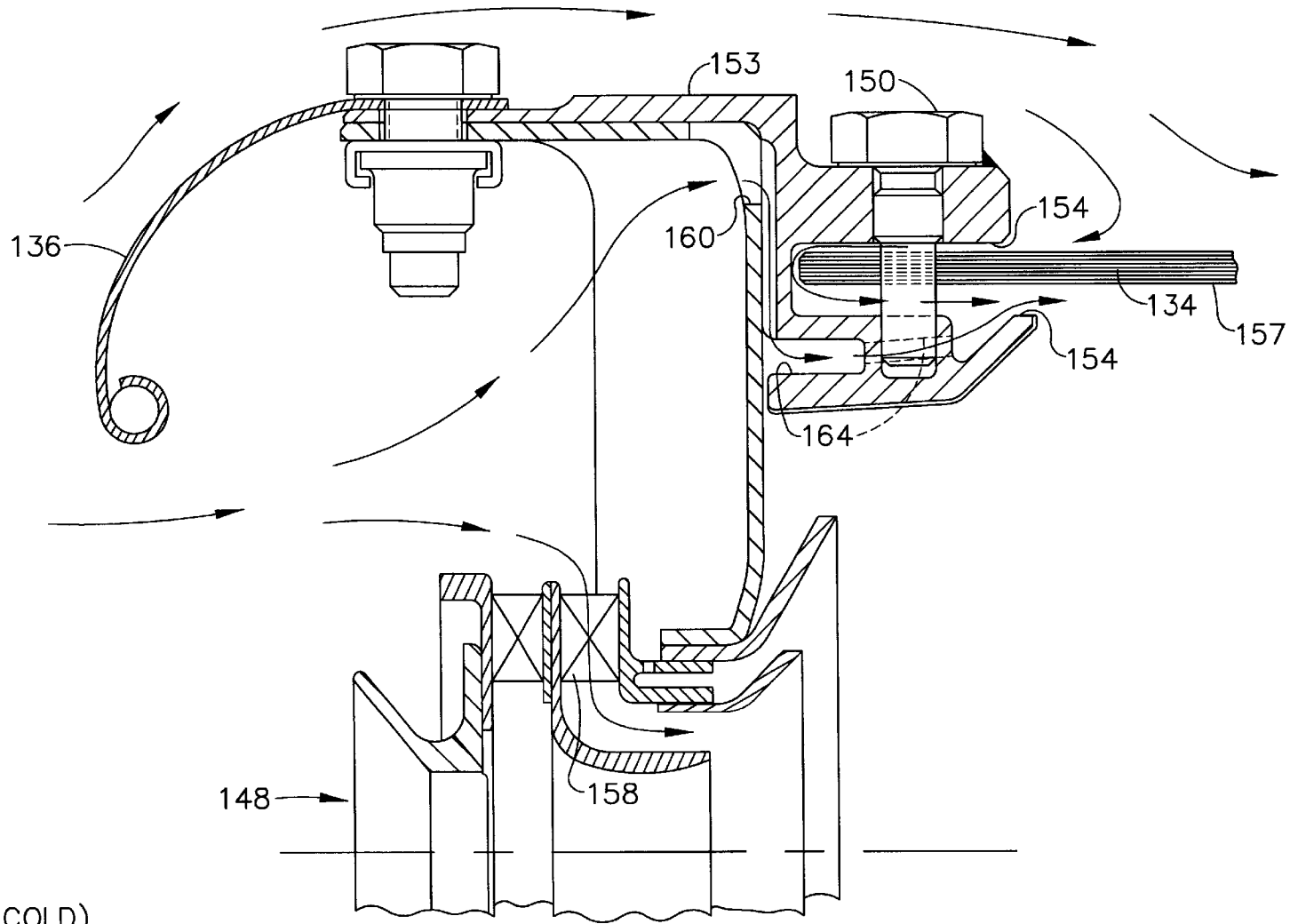
FIG. 10 (COLD)

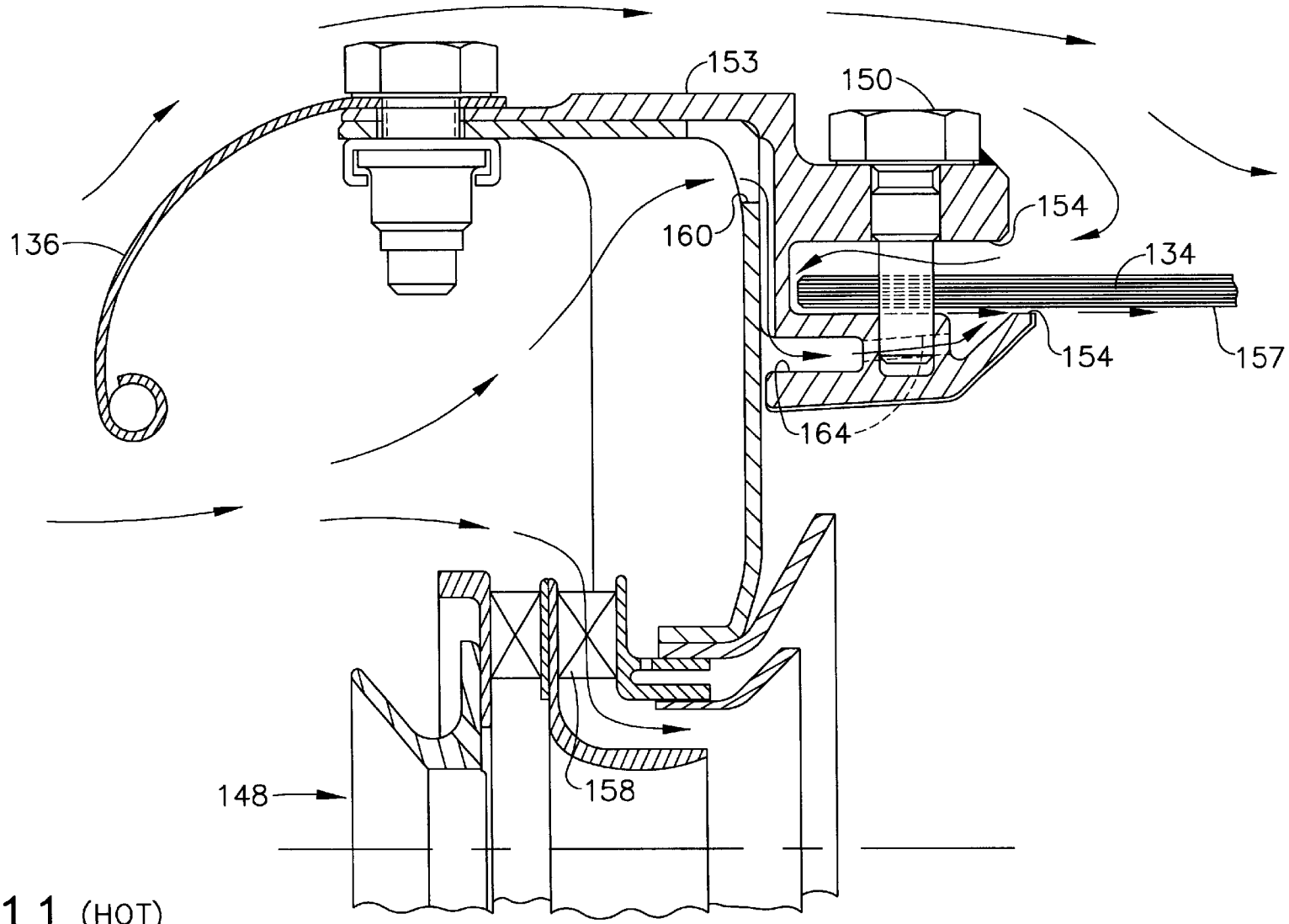
FIG. 11 (HOT)

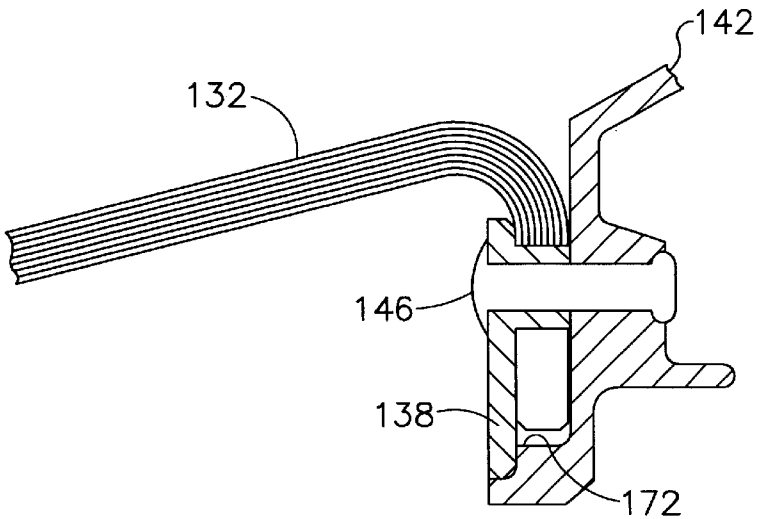
FIG. 13 (HOT)
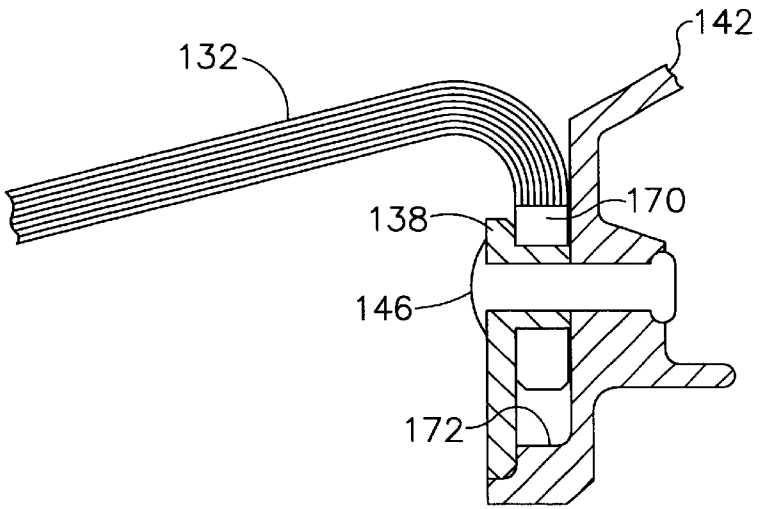
FIG. 12 (COLD)

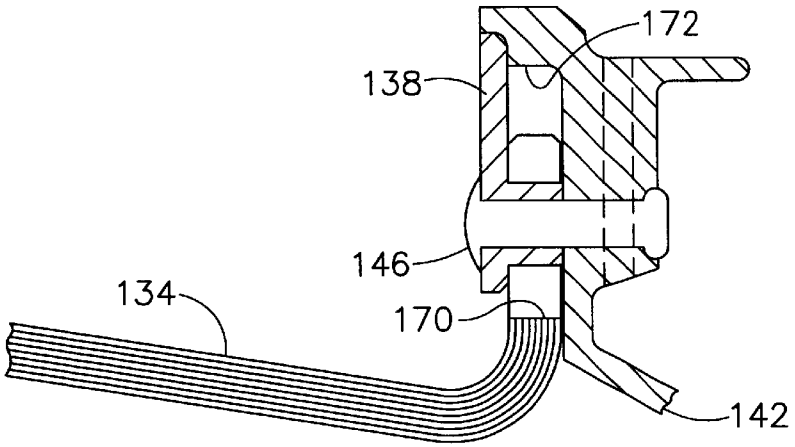
FIG. 15 (HOT)
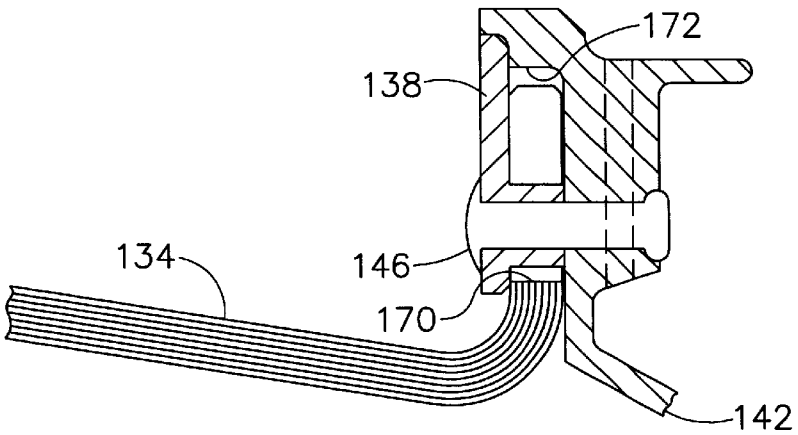
FIG. 14 (COLD)

CONBUSTOR HAVING A CERAMIC MATRIX COMPOSITE LINER

FIELD OF THE INVENTION

This invention relates to combustors used in gas turbine engines, and specifically to combustors having ceramic matrix combustor liners that can interface with engine components made from different materials having dissimilar thermal responses.

BACKGROUND OF THE INVENTION

Improvements in manufacturing technology and materials are the keys to increased performance and reduced costs for many articles. As an example, continuing and often interrelated improvements in processes and materials have resulted in major increases in the performance of aircraft gas turbine engines. One of the most demanding applications for materials can be found in the components used in aircraft jet engines. The engine can be made more efficient resulting in lower specific fuel consumption while emitting lower emissions by operating at higher temperatures. Among the current critical limitations on the achievable operating temperatures of the engine are the materials used in the hottest regions of the engine, which include the combustor portion of the engine and the portions of the engine aft of the combustor portion including the turbine portion of the engine. Temperatures in the combustor portion of the engine can approach 3500° F., while materials used for combustor components can withstand temperatures in the range of 2200–2300° F. Thus, improvements in the high temperature capabilities of materials designed for use in aircraft engines can result in improvements in the operational capabilities of the engine.

One of the portions of the engine in which a higher operating temperature is desired so that overall operating temperature of the engine can be achieved is the combustor chamber. Here, fuel is mixed with air and ignited, and the products of combustion are utilized to power the engine. The combustor chambers include a number of critical components, including but not limited to the swirler/dome assembly, seals and liners. In the past, these components have been made of metals having similar thermal expansion behavior, and temperature improvements have been accomplished by utilization of coatings, cooling techniques and combinations thereof. However, as the operating temperatures have continued to increase, it has been desirable to substitute materials with higher temperature capabilities for the metals. However, such substitutions, even though desirable, have not always been feasible. For example, as noted previously, the combustors operate at different temperatures throughout the operating envelope of the engine. Thus, when differing materials are used in adjacent components of the combustor, or even in components adjacent to the combustor, widely disparate coefficients of thermal expansion in these components can result in a shortening of the life cycle of the components as a result of thermally induced stresses, particularly when there are rapid temperature fluctuations which can also result in thermal shock.

The concept of using non-traditional high temperature materials such as ceramic matrix composites as structural components in gas turbine engines is not novel. U.S. Pat. Nos. 5,488,017 issued Jan. 30, 1996 and U.S. Pat. No. 5,601,674 issued Feb. 11, 1997, assigned to the assignee of the present application, sets forth a method for making engine components, of ceramic matrix components. However, the disclosure fails to address problems that can be associated with mating parts having differing thermal expansion properties.

U.S. Pat. Nos. 5,291,732 issued Mar. 8, 1994, U.S. Pat. No. 5,291,733 issued Mar. 8, 1994 and U.S. Pat. No. 5,285,632 issued Feb. 15, 1994, assigned to the assignee of the present invention, address the problem of differential thermal expansion between ceramic matrix composite combustor liners and mating components. This arrangement utilizes a mounting assembly having a supporting flange with a plurality of circumferentially spaced supporting holes. An annular liner also having a plurality of circumferentially spaced mounting holes is disposed coaxially with the flange. The liner is attached to the flange by pins that are aligned through the supporting holes on the flange and through the mounting holes on the liner. The arrangement of the pins in the mounting holes permits unrestrained differential thermal movement of the liner relative to the flange.

The present invention provides an alternate arrangement for reducing or eliminating thermally induced stresses in combustion liners and mating parts while permitting unrestrained thermal expansion and contraction of combustor liners.

SUMMARY OF THE INVENTION

The present invention provides for a combustor having liners made from ceramic matrix composite materials (CMC's) that are capable of withstanding higher temperatures than metallic liners. The ceramic matrix composite liners are used in conjunction with mating components that are manufactured from metallic materials. To permit the use of a combustor having liners made from CMC materials in conjunction with metallic materials used for the mating forward cowls and aft seals with attached seal retainer over the broad range of temperatures of a combustor, the combustor is manufactured in a manner to allow for the differential thermal expansion of the differing materials at their interfaces in a manner that does not introduce stresses into the liner as a result of thermal expansion.

A significant advantage of the present invention is that the interface design that permits the differential thermal expansion of the various materials of the components permits the use of ceramic matrix composites for combustor liners by eliminating the thermal stresses that typically shorten the life of the combustors as a result of differential thermal expansion of the parts. The use of the CMC liners allows the combustors to operate at higher temperatures with less cooling air than is required for conventional metallic liners. The higher temperature of operation results in a reduction of NOX emissions by reducing the amount of unburned air from the combustor.

A second advantage of the combustor of the present invention is that is addresses the problems associated with differential thermal growth of interfacing parts of different materials.

Yet another advantage of the present invention is that the interface connections between the CMC liners and the liner dome supports regulates part of the cooling air flow through the interface joint to initiate liner film cooling. Thus, cooling air flow across the combustor liner is not solely dependent on cooling holes as in prior art combustors and state-of-the-art CMC manufacturing technology can be used to manufacture the liners.

Other features and advantages of the present invention will be apparent from the following more detailed description of the preferred embodiment, taken in conjunction with the accompanying drawings which illustrate, by way of example, the principles of the invention.

BRIEF DESCRIPTION OF THE DRAWINGS

FIG. 3 is a schematic sectional view of inner and outer liners made from ceramic matrix composite material mounted to a metallic single dome combustor;

FIG. 4 is a partial schematic of a ceramic matrix composite inner liner of FIG. 2 or 3 assembled to interfacing metallic parts while the engine is hot;

FIG. 5 is a partial schematic of a ceramic matrix composite outer liner of FIG. 2 or 3 assembled to interfacing metallic parts while the engine is cold;

FIG. 6 is a partial schematic of a ceramic matrix composite inner liner of FIG. 2 or 3 assembled to interfacing metallic parts with the engine in a cold condition;

FIG. 7 is a partial schematic of a ceramic matrix composite outer liner of FIG. 2 or 3 assembled to interfacing metallic parts with the engine in a hot operating condition;

FIG. 8 is a partial schematic of the of a ceramic matrix composite inner liner attachment to the metallic support depicting the airflow through and around the dome and cowl in the hot condition;

FIG. 9 is a partial schematic of a ceramic matrix composite inner liner attachment to the metallic support depicting the airflow through and around the dome and cowl in the engine cold condition;

FIG. 10 is a partial schematic of the of a ceramic matrix composite outer liner attachment to the metallic support depicting the airflow through and around the dome and cowl in the cold condition and in the engine start condition;

FIG. 11 is a partial schematic of a ceramic matrix composite outer liner attachment to the metallic support depicting the airflow through and around the dome and cowl in the engine hot running condition;

FIG. 12 is a partial schematic of the CMC inner liner attachment to the metallic aft seal in the cold condition and in the engine start condition;

FIG. 13 is a partial schematic of the CMC inner liner attachment to the metallic aft seal in the engine hot running condition;

FIG. 14 is a partial schematic of the CMC outer liner attachment to the metallic aft seal in the cold condition and in the engine start condition;

FIG. 15 is a partial schematic of the CMC outer liner attachment to the metallic aft seal in the engine hot running condition;

Whenever possible, the same reference numbers will be used throughout the figures to refer to the same parts.

DETAILED DESCRIPTION OF THE PREFERRED EMBODIMENTS

The present invention provides a combustor that includes ceramic matrix composite (CMC) liners that can operate at higher temperatures than conventional combustors, but which allow for differential thermal growth of interfacing parts of different materials.

Figure 1:
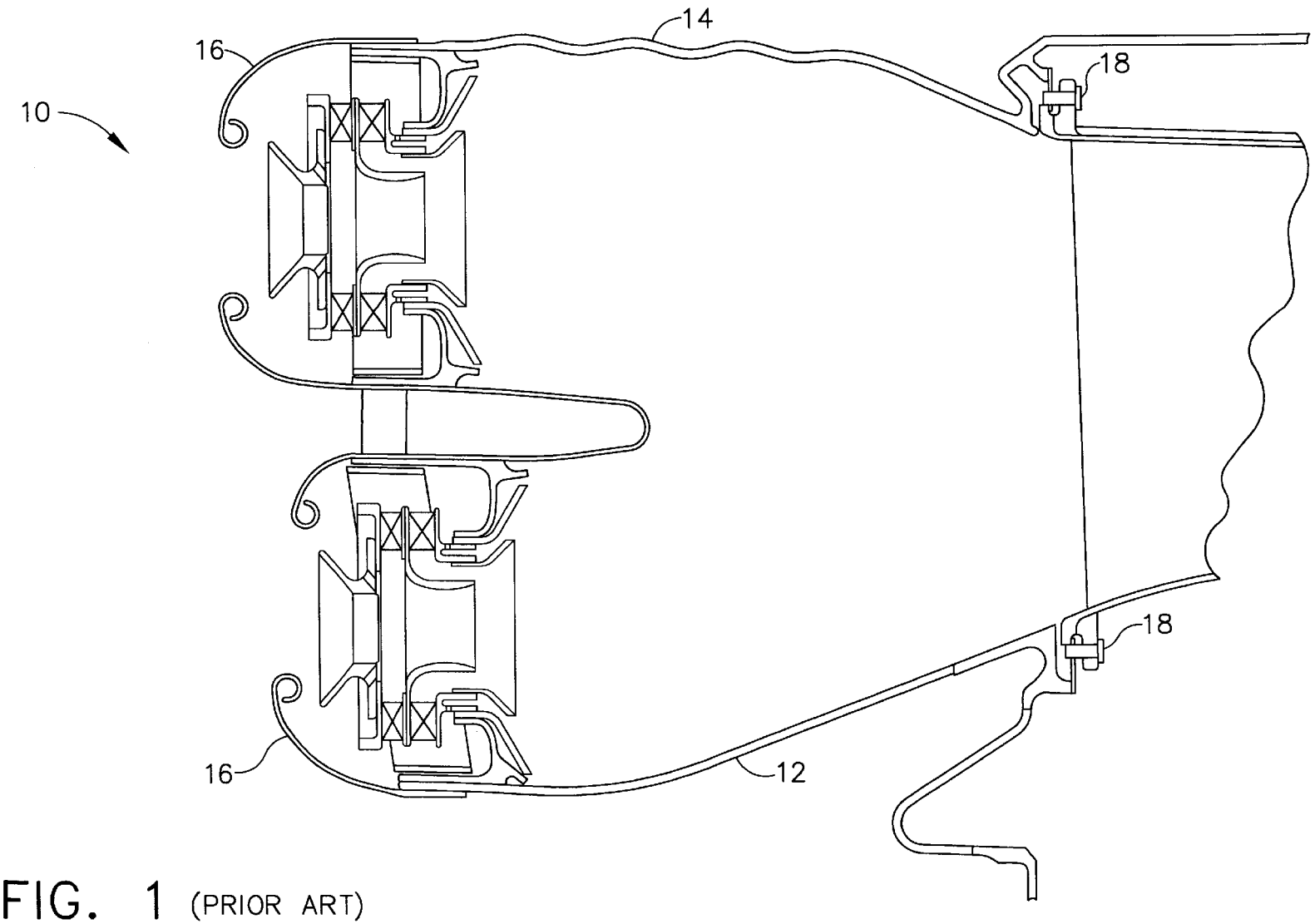
FIG. 1 (PRIOR ART)
FIG. 1 is a schematic sectional view of a prior art dual dome combustor made from metallic materials.

FIG. 1 is a schematic sectional view of a prior art dual dome combustor 10 made from conventional metallic materials. In this design, the inner liner 12 and outer liner 14 extend from the forward cowls 16 to the aft seal retainers 18. Because the dual dome combustor is made from metallic materials having high temperature capabilities and identical or similar coefficients of thermal expansion, the design does not have to allow for differential thermal growth as the components of the combustor expand and contract at substantially the same rates. Because the design does not allow for differential thermal expansion of the components making up the combustor, it is not possible to simply substitute a combustor liner made from a CMC material for the existing metallic combustor liners 12, 14, as the differential thermal expansion between the parts will introduce severe thermal stresses that will shorten the life of the combustor.

Figure 2:
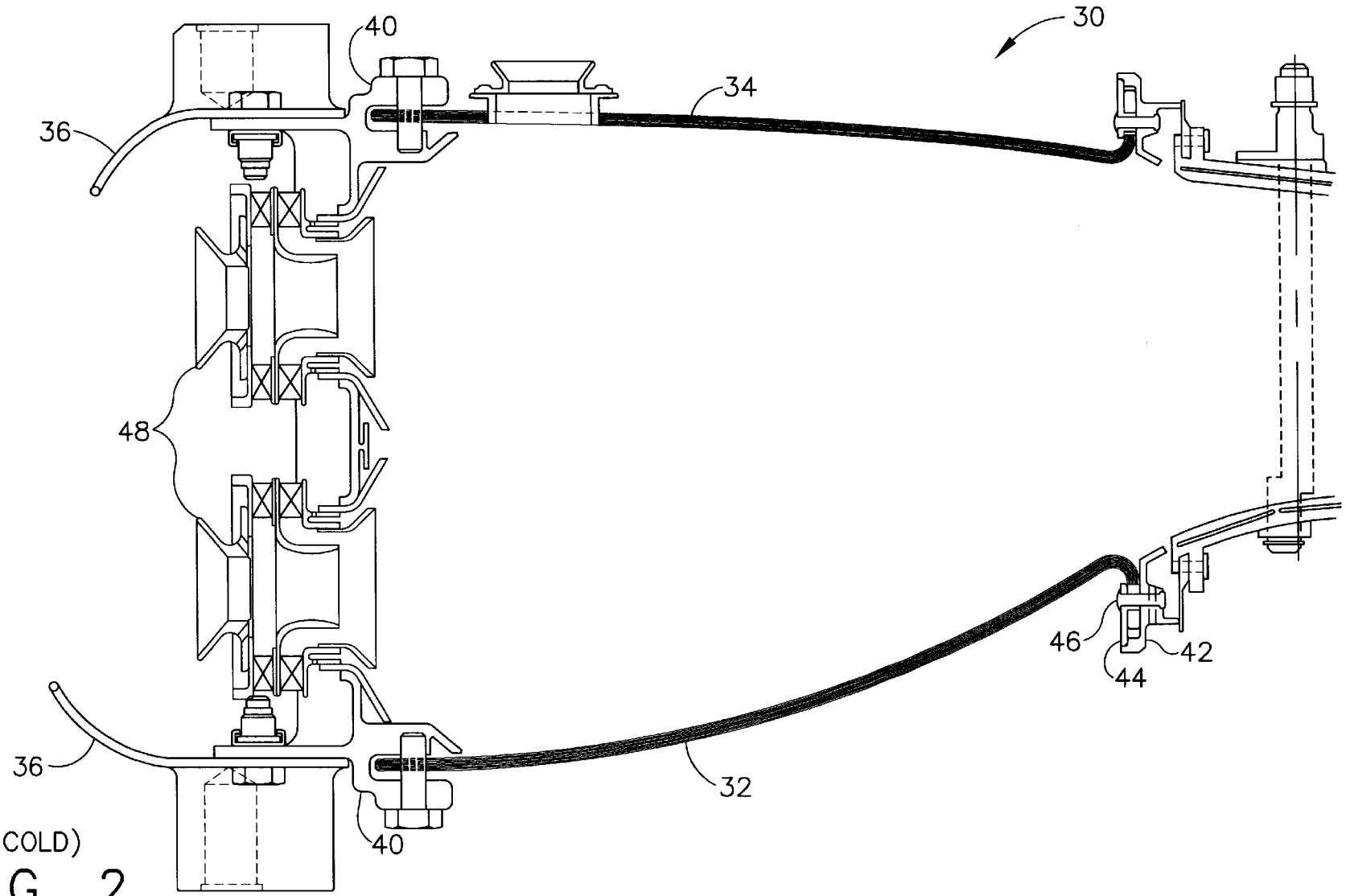
FIG. 2 is a schematic sectional view of inner and outer liners made from ceramic matrix composite material mounted to a conventional metallic dual dome combustor.

FIG. 2 is a schematic sectional view of a dual dome combustor 30 of the present invention having an inner liner 32 and an outer liner 34 made from CMC materials. The design is comprised of two metallic forward cowls 36 at the front end of the combustor attached to liner dome supports 40. Inner and outer liners 32, 34, extend between liner dome supports 40 and aft seals 42. The liners are attached to the aft seal 42 by seal retainer 44 and fasteners 46. The combustor 30 of FIG. 2 includes a pair of fuel nozzle swirlers 48.

FIG. 3 is a schematic sectional view of a single dome combustor 130 of the present invention having an inner liner 132 and an outer liner 134 made from CMC materials. The design is comprised of two metallic forward cowls 136 at the front end of the combustor attached to liner dome supports 140. Inner and outer liners 132, 134, extend between an outer liner dome support 140 and aft seal 142 and an inner liner dome support 141 and aft seal 142. The liners are attached to the aft seal 142 by seal retainers 138 and fasteners 146. The combustor 130 of FIG. 2 includes a single fuel nozzle swirler 148.

The operation of both the double dome combustor 30 and the single dome combustor 130 is similar in principle. For simplicity, reference will be made to FIG. 3 for the single dome combustor 130. The forward cowls 136 create a plenum to permit air to flow into the combustor chamber from the compressor portion of the engine (not shown). The liner support domes 140 provide the forward support of the combustion chamber and the mounting surfaces for the fuel nozzle swirler 148. The liner dome supports also serve as an attachment point for one end of inner and outer liners 132, 134 respectively. The liner dome supports also provide cooling holes for film cooling of the liners. Inner and outer liners 132, 134 are the inner and outer walls of the combustion chamber. The flame is formed aft of fuel nozzle swirler 148 and extends back in the direction of aft seal 142. Aft seal 142 forms a sealing surface at the exit of the combustor to prevent high temperature and pressure air from leaking into the high pressure turbine nozzle (not shown) through the joint between liners 132, 134 and aft seals. Liners are attached to the aft seal with fasteners 146.

FIGS. 9 and 10 are enlarged schematics of FIG. 3 of the of a ceramic matrix composite inner liner attachment and outer liner attachment to their respective metallic supports depicting the airflow through and around the dome and cowl in the cold condition and in the engine start condition. The arrows depict the direction and path of the airflow. Referring to FIG. 9, inner liner 132 is assembled with mount pins 150 to inner liner support 152. Mount pins 150 provide for the axial positioning of liner 132. Additionally, mount pins 150 allow for the compensation of the differential thermal growth between liner 132 made from CMC and the metallic mount of inner liner support dome 141. Some air from the compressor flows outside around the cowl 136 and along the outside of inner liner 132. Some air flows between an aperture or gap 154 between inner liner 132 and inner liner support 152 and along the inside surface 156 of liner 132 to provide cooling. Additional air is directed into cowl 136. Some of the air flows into plenum 158 and into nozzle swirler to support combustion of fuel metered into fuel nozzle swirler. Additional air flows through aperture 160, into channel 164, cooling the cowl and the nozzle swirler, where it is directed along inside surface 156 of liner 132. The arrangement of FIG. 10 is essentially a mirror image of FIG. 8, except that they depict the outer liner 134 and outer liner support 153. The amount and ratio of cooling air flowing through gap154 and channel 164 in the cold engine condition is not as critical as in the hot engine condition.

FIGS. 8 and 11 are enlarged partial schematics corresponding to FIG. 9 and 10 of a ceramic matrix composite inner liner attachment and outer liner assembled to their respective metallic supports depicting the airflow through and around the dome and cowl in the hot engine condition. The arrows depict the direction and path of the airflow. Referring to FIG. 8 for the inner liner, as a result of differential thermal expansion, gap 154 becomes smaller as liner 132 moves axially outward with respect to inner liner support 152and the amount of cooling air moving through the gap 154 is reduced as liner 132 and inner liner support 152 expand at different rates. But gap 154 is designed to allow for this differential expansion and prevent severe stresses from being introduced into liner 132. As can be seen and as previously noted, mount pins 150 which provide for the axial positioning of liner 132 additionally allow for the compensation of the differential thermal growth between liner 132 made from CMC and the metallic mount of inner liner support dome 141. Some air from the compressor flows outside around the cowl 136 and along the outside of inner liner 132. The additional air flowing through aperture 160, into and through channel 164 onto the inside surface 156 of liner is also reduced as a result of the differential thermal expansion of the CMC liner 132 outward in relation to inner liner support 152. This increased cooling balances the cooling lost through gap 154. The arrangement of FIG. 11 for the outer liner is essentially a mirror image of FIG. 9 for the inner liner, except that outer liner 134 and outer liner support 153 are substituted for the inner liner 132 and inner liner support. Here, however, the movement of the outer liner with respect to the outer liner support is in the opposite direction and additional air flowing through gap 154 compensates for cooling air lost through channel 164.

Differential thermal expansion between the CMC liners 132, 134 and the aft seals 142 of the combustor is also provided by the arrangement of the present invention. Referring now to FIGS. 12 and 14, which are partial schematics of the CMC, inner liner attachment and outer liner attachment to the metallic aft seal respectively in the cold condition and in the engine start condition. The arrangements of the inner liner attachment and the outer liner attachments in FIG. 12 and 14 are essentially identical except for the numbering of the inner and outer liner components. For simplicity, reference will be made to FIG. 12 and the inner liner components, it being understood that the arrangement of the outer liner components is substantially similar. Inner liner 132, made from a CMC, is positioned between metallic seal retainer 138 and metallic aft seal 142. Inner liner 132 is positioned between metallic seal retainer 138 and aft seal 142 by a fastener 146, preferably a rivet. Small slots 170 and retainer gaps 172 are designed into the joint between liner 132, retainer 138 and seal 142 to allow for differential expansion. Slots 170 are designed between liner 132 and seal retainer 138 to account for expansion of aft seal 142 and corresponding movement of fasteners 146, preferably metallic rivets, while retainer gaps 172 are designed between retainer 138 and seal 142 to permit movement among aft seal 142, retainer 138 and liner 132. FIGS. 13 and 15 illustrate the effect of the differential thermal expansion of the inner and outer liner respectively, the seal and the seal retainer.

Figure 16:
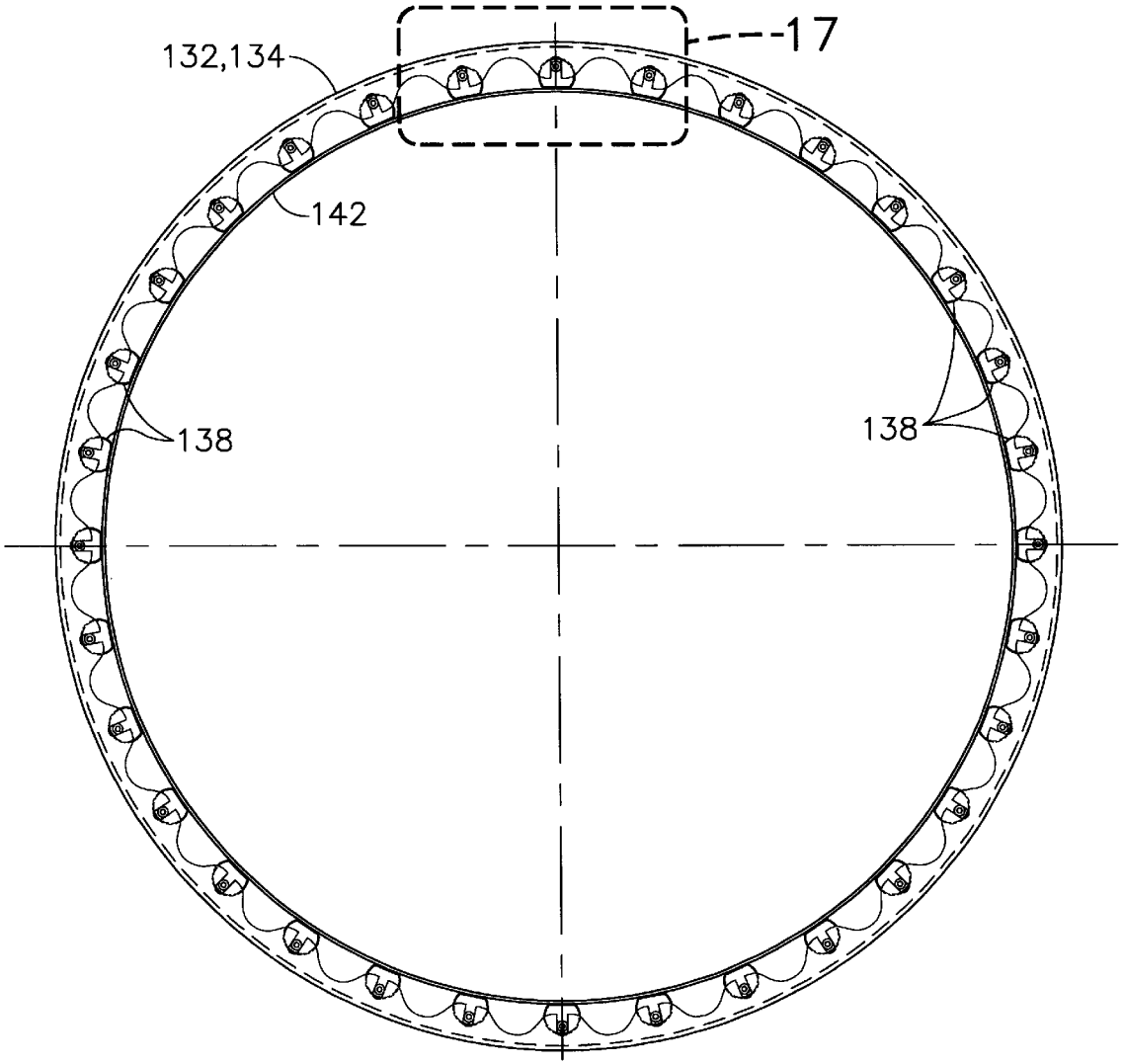
FIG. 16 is a 360° aft looking forward sectional view showing the CMC inner liner aft flange with radial slots, individual seal retainers and a section of the aft seal.
Figure 17:
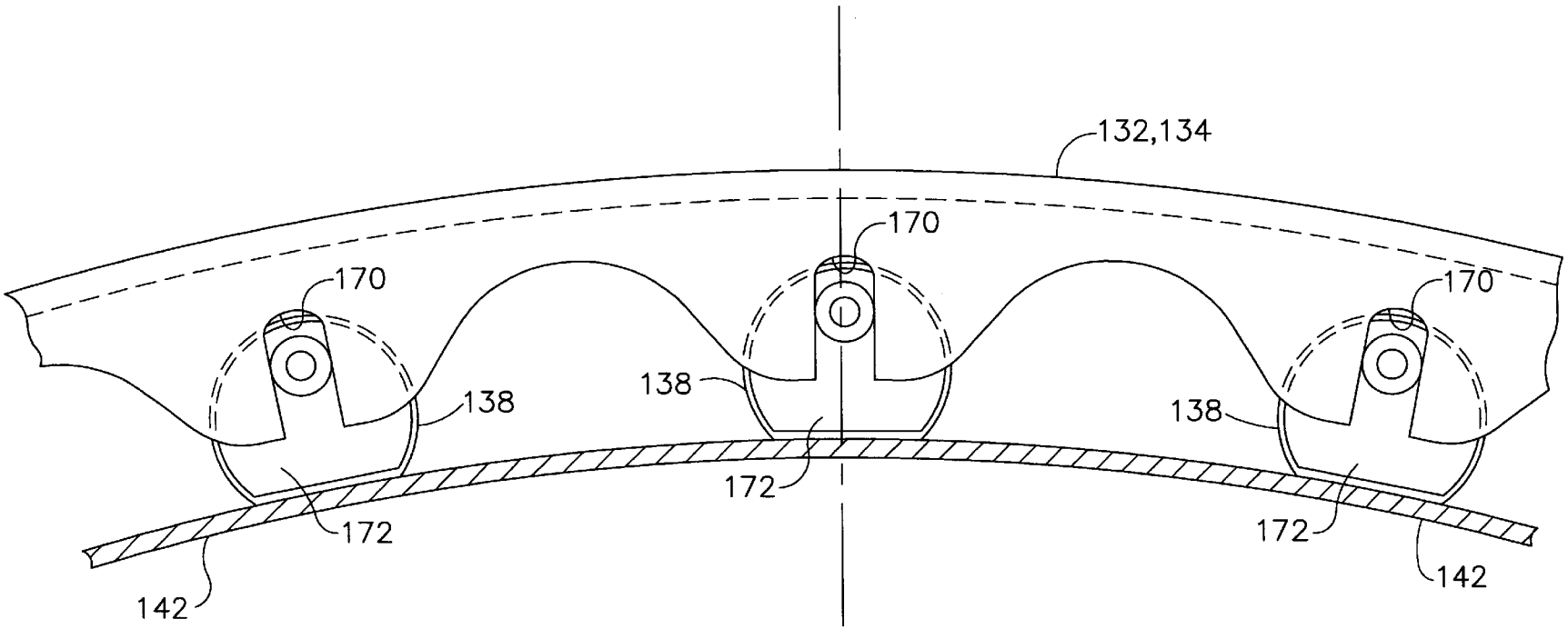
FIG. 17 is an enlarged view of a portion of the section shown in FIG. 16 showing the ceramic matrix composite inner liner aft flange with radial slots, individual seal retainers and a section of the aft seal.

FIG. 16 is a 360° aft looking forward sectional view showing the CMC inner liner aft flange with radial slots, individual seal retainers and a section of the aft seal, while FIG. 17 is an enlarged view of a portion of the section shown in FIG. 16 showing the ceramic matrix composite inner liner aft flange with radial slots, individual seal retainers and a section of the aft seal. Because slots 170 and gaps 172 are designed to account for differential thermal expansion of the different materials of the parts, slots 170 and gaps 172 are significantly smaller in the hot engine condition; however, stresses in the liner that would otherwise result from the differential thermal expansion of the materials are eliminated.

The materials typically used for both the forward cowl portion of the combustor and the aft seal and seal retainers are superalloy materials that are capable of withstanding the elevated temperatures and the corrosive and oxidative atmosphere of the hot gases of combustion experienced in the combustor atmosphere. These superalloy materials typically are nickel-based superalloys specially developed to have an extended life in such an atmosphere having a coefficient of thermal expansion of about $8.8–9.0\times10^{-6}$ in/in/° F. or cobalt-based superalloys having a coefficient of thermal expansion of about $9.2–9.4\times10^{-6}$ in/in/° F. The CMC composites used for combustor liners typically are silicon carbide, silica or alumina matrix materials and combinations thereof. The method of manufacturing the CMC material typically involves the melt infiltration process. For example, silicon metal is melt-infiltrated into a fiber preform holding preassembled fiber. The melt infiltration process typically results in the presence of unconverted, residual silicon in the SiC matrix. Embedded within the matrix are ceramic fibers such as oxidation stable reinforcing fibers including monofilaments like sapphire and silicon carbide such as Textron's SCS-6, as well as rovings and yarn including silicon carbide such as Nippon Carbon's NICALON®, in particular HI-NICALON® AND HI-NICALON-S®, Ube Industries' TYRANNO®, in particular TYRANNO® ZMI and TYRANNO® SA, and Dow Corning's SYLRAMIC®, and alumina silicates such as Nextel's 440 and 480, and chopped whiskers and fibers such as Nextel's 440 and SAFFIL®, and optionally ceramic particles such as oxides of Si, Al, Zr, Y and combinations thereof and inorganic fillers such as pyrophyllite, wollastonite, mica, talc, kyanite and montmorillonite. An example of typical CMC materials and methods of making such composites is illustrated in U.S. Pat. No. 5,601,674 to Millard et al. issued Feb. 11, 1997 and assigned to the assignee of the present invention, incorporated herein by reference. CMC materials typically have coefficients of thermal expansion in the range of about $1.3\times10^{-6}$ in/in/° F. to about $2.8\times10^{-6}$ in/in/° F. In a preferred embodiment, the liners are comprised of silicon carbide fibers embedded in a melt-infiltrated silicon carbide matrix.

FIGS. 5 and 6 are partial schematics of the ceramic matrix composite outer liner and inner liner respectively of FIG. 2 or 3 assembled to interfacing metallic parts while the engine is cold. The gaps between the CMC liners in the region of the attachment of the liners to the aft seals can now be better understood with reference to FIGS. 12 and 14; and in the region of the attachment to the liner support domes with reference to FIGS. 9 and 10. These gaps can be contrasted with the gaps in FIGS. 4 and 7 which are partial schematics of a ceramic matrix composite inner liner and outer liner assembled to interfacing metallic parts with the engine in a hot operating condition. A more detailed reference can also be made to FIGS. 8, 11, 13 and 15 for the hot operating conditions of the combustor of the present invention.

Although the present invention has been described in connection with specific examples and embodiments, those skilled in the art will recognize that the present invention is capable of other variations and modifications within its scope. These examples and embodiments are intended as typical of, rather than in any way limiting on, the scope of the present invention as presented in the appended claims.

What is claimed is:

1. A combustor for use in a gas turbine engine, comprised of:

a forward cowl made from a metallic material capable of withstanding elevated temperatures of combustion in an oxidative and corrosive atmosphere having a first coefficient of thermal expansion;

an aft seal attached to a seal retainer, the aft seal having a second coefficient of thermal expansion and the seal retainer having a third coefficient of thermal expansion, each made from a metallic material capable of withstanding elevated temperatures of combustion in an oxidative and corrosive atmosphere; and a combustion liner made from a ceramic matrix composite material capable of withstanding elevated temperatures of combustion in an oxidative and corrosive atmosphere having a fourth coefficient of thermal expansion less than the first coefficient of thermal of the forward cowl and less than the second coefficient of thermal expansion of the aft seal and less than the third coefficient of thermal expansion of the seal retainer, the combustor liner positioned between the forward cowl and aft seal with attached seal retainer in a manner to permit differential thermal expansion of the ceramic combustor liner, the forward cowl and the aft seal with attached seal retainer without introducing stresses into the liner sufficient to fracture the liner as a result of differential thermal expansion at elevated temperatures.

2. The combustor of claim 1 wherein the combustor includes an inner combustor liner and an outer combustor liner.

3. The combustor of claim 1 wherein the combustor liner is a CMC material in which the matrix includes at least a silicon carbide ceramic.

4. The combustor of claim 3 wherein the combustor liner further includes a CMC material having silicon carbide fiber embedded in the matrix.

5. The combustor of claim 1 wherein the combustor liner is a CMC material having a matrix that includes at least an alumina.

6. The combustor of claim 5 wherein the combustor liner further includes a CMC material having sapphire fiber embedded in the matrix.

7. A combustor for use in a gas turbine engine, comprised of:

at least one metallic forward cowl at a fore end of the combustor;

a metallic inner dome support including an inner liner support attached to the at least one forward cowl, the inner liner support including an expansion aperture;

a metallic outer dome support including an outer liner support attached to the at least one forward cowl, the outer liner support including an expansion aperture;

a fuel nozzle swirler attached to the a dome supports to mix fuel and air to initiate combustion of fuel and direct hot gases of combustion into a combustion chamber and then into a turbine portion of the gas turbine engine;

at least one metallic aft seal at the aft end of the combustor;

a metallic aft seal retainer attached to the aft seal so that a gap is created between the aft seal and the at least one aft seal retainer;

a ceramic inner combustion liner forming the inner wall of the combustor chamber and having a forward attachment and an aft attachment in the form of a flange extending away from a centerline of the combustor, the liner extending between the inner dome support and the at least one aft seal, the forward attachment of the combustion liner assembled into the expansion aperture in the inner liner support, and the aft attachment fitting into the gap between the aft seal and the at least one aft seal retainer;

a ceramic outer combustion liner forming an outer wall of the combustor chamber and having a forward attachment and an aft attachment in the form of a flange extending away from a centerline of the combustor, the liner extending between the outer dome support and the at least one aft seal, the forward attachment of the combustion liner assembled into the expansion aperture of the liner support, and the aft attachment fitting into the gap between the aft seal and the at least one aft seal retainer; and means for attaching the combustor liners to the liner supports.

8. The combustor of claim 7 wherein the means for attaching combustor liners to the liner supports includes fasteners that extend through an aperture in the combustor liners that permit movement of the liners in the axial direction of the fasteners to compensate for differential thermal growth between the liner support domes and the liners due to temperature changes.

9. The combustor of claim 8 wherein the fasteners include pins.

10. The combustor of claim 8 wherein the fasteners included threaded members.

11. The combustor of claim 7 wherein air is introduced into the expansion gap in the liner supports to provide film cooling to an inner surface of the ceramic liners.

12. The combustor of claim 7 wherein the flange of the inner liner includes a plurality of radial slots to position the inner liner between the aft seal and aft seal retainer and to allow for movement of the aft seal and aft seal retainer with respect to the liner to compensate for differential thermal growth between the aft seal, the aft seal retainer and the liner due to temperature changes.

13. The combustor of claim 12 wherein the inner liner is retained in position within the gap between the aft seal and aft seal retainer by a fastener extending through each aperture in the aft seal, each aperture in the aft seal retainer and the radial slot in the inner liner flange.

14. The combustor of claim 12 wherein the aft seal retainer includes a gap to permit movement among the inner liner, the aft retainer and the aft seal retainer.

15. The combustor of claim 7 wherein the flange of the outer liner includes a plurality of radial slots to position the inner liner between the aft seal and aft seal retainer and to allow for movement of the aft seal and aft seal retainer with respect to the liner to compensate for differential thermal growth between the aft seal, the aft seal retainer and the liner due to temperature changes.

16. The combustor of claim 15 wherein the outer liner is retained in position within the gap between the aft seal and aft seal retainer by a fastener extending through each aperture in the aft seal, each aperture in the aft seal retainer and the radial slot in the outer liner flange.

17. The combustor of claim 12 wherein the aft seal retainer includes a gap to permit movement among the outer liner, the aft retainer and the aft seal retainer.

18. The combustor of claim 7 wherein the ceramic inner and outer liners are ceramic matrix composite material.

19. The combustor liner of claim 18 wherein the ceramic matrix composite is capable of withstanding elevated temperatures and corrosive and oxidative environments.

20. The combustor liners of claim 18 wherein the ceramic matrix composite material is comprised of a fiber-reinforced silica matrix material.

21. The combustor liners of claim 20 wherein the ceramic matrix composite material further includes ceramic particles.

22. The combustor liners of claim 20 wherein the fiber reinforcement is an oxidation stable monofilament.

* * * * *

UNITED STATES PATENT AND TRADEMARK OFFICE

CERTIFICATE OF CORRECTION

PATENT NO. : 6,397,603 B1
DATED : June 4, 2002
INVENTOR(S) : Edmondson et al.

It is certified that error appears in the above-identified patent and that said Letters Patent is hereby corrected as shown below:

Title page,
Item [73], Assignee should read:

-- [73] Assignee: General Electric Company,
Schenectady, NY (US) --

Signed and Sealed this

Fourteenth Day of January, 2003

JAMES E. ROGAN
*Director of the United States Patent and Trademark Office*